US008151864B2

(12) United States Patent
Meier

(10) Patent No.: US 8,151,864 B2
(45) Date of Patent: Apr. 10, 2012

(54) SYSTEM FOR SEALING A DUMMY BAR HEAD IN A MOULD OF A CONTINUOUS CASTING PLANT FOR CASTING LARGE-FORMAT PRELIMINARY SECTIONS

(75) Inventor: Thomas Meier, Schauffhausen (CH)

(73) Assignee: SMS Concast AG, Zurich (CH)

( * ) Notice: Subject to any disclaimer, the term of this patent is extended or adjusted under 35 U.S.C. 154(b) by 287 days.

(21) Appl. No.: 12/469,804

(22) Filed: May 21, 2009

(65) Prior Publication Data

US 2010/0132909 A1 Jun. 3, 2010

(30) Foreign Application Priority Data

May 23, 2008 (EP) ..... 08009465

(51) Int. Cl.
*B22D 11/08* (2006.01)

(52) U.S. Cl. ..... 164/425; 164/445

(58) Field of Classification Search ..... 164/425–426, 164/445–446, 483
See application file for complete search history.

(56) References Cited

U.S. PATENT DOCUMENTS 3,262,161 A * 7/1966 Andrzejak et al. ..... 164/425
4,719,960 A * 1/1988 Grothe et al. ..... 164/426
5,456,307 A * 10/1995 Mouri ..... 164/446

FOREIGN PATENT DOCUMENTS

EP 320681 * 6/1989

* cited by examiner

*Primary Examiner* — Kuang Lin
(74) *Attorney, Agent, or Firm* — Brian Roffe

(57) ABSTRACT

In a system for sealing a dummy bar head in a mould of a continuous casting plant for casting large-format preliminary sections, a flat gasket (6) to seal the gap between the dummy bar head and the mould is provided, which is held on a packing plate (7) contained on the dummy bar head. Said packing plate has approximately the cross-sectional shape of the mould profile and covers the flat gasket (6). The packing plate (7) is displaceable towards the centre of the mould by an amount which is a function of the conicity of the mould (3). To this end, it consists of two plate halves (7*a*, 7*b*) lying in one plane with respect to each other. This makes it possible, when inserting the dummy bar head, to compensate for the angled course of the mould with the contracting packing plate until the sealing gap between packing plate and mould remains uniform on all sides.

15 Claims, 3 Drawing Sheets

SYSTEM FOR SEALING A DUMMY BAR HEAD IN A MOULD OF A CONTINUOUS CASTING PLANT FOR CASTING LARGE-FORMAT PRELIMINARY SECTIONS

FIELD OF THE INVENTION

The invention concerns a system for sealing a dummy bar head in a mould of a continuous casting plant for casting large-format preliminary sections, with a flat gasket sealing the gap between the dummy bar head and the mould, and also a packing plate fixing the flat gasket onto the dummy bar head, which has approximately the cross-sectional form of the mould profile and completely covers the flat gasket.

BACKGROUND OF THE INVENTION

Continuous casting plants of this type are used, for example, for producing large so-called beam-blank formats with a double-T profile of over 800 mm length, over 400 mm width of flange and approximately 120 mm web thickness. The dummy bar head is also used, as is known in the art, to seal off the mould underneath before and during the casting start-up process.

During casting, the molten mass is poured through a pouring spout and channel into the interior cavity of the mould where it solidifies until it can be drawn off with the dummy bar head as a hot bar. To compensate for the shrinkage of the bar in the mould which occurs during the solidification process, the mould forms a conicity by running slightly at an angle from the top down. Since large beam-blank formats are cast more slowly than smaller formats, they require a relatively large conicity in the mould. For this reason, the entrance to the mould for such formats is about 6-12 mm larger than the exit.

Before starting casting, the dummy bar head with the associated packing is mounted above the mould and then inserted into the mould until it has reached the position for start of casting therein. Since the packing in systems of prior art is rigid, due to the conicity of the mould, a gap forms there at the inner shoulder of the profile. In the case of large formats, the gap is unacceptably wide. It is especially important in the casting start-up position, however, for the dummy bar packing to have a perfect seal, in order to prevent molten mass flowing out of the interior of the mould during casting. State of the art systems are therefore unsuitable for casting especially large-format profiles.

SUMMARY OF THE INVENTION

The invention is based on the problem of avoiding the disadvantages mentioned above and creating a dummy bar packing which guarantees a complete seal of the dummy bar packing when casting, even of especially large formats.

This problem is solved according to the invention by the fact that the packing plate fixing the flat gasket is displaceable towards the centre of the mould by an amount which is a function of the conicity of the mould.

This makes it possible, when inserting the dummy bar head, to compensate for the angled course of the mould with the contracting packing plate until the sealing gap between packing plate and mould remains uniform on all sides. As a result, the flat gasket can seal it completely, even when casting especially large formats.

With a view to a simple construction and safe working, the invention further makes provision that the packing plate is made in two parts, with both plate halves being displaceable towards the centre of the mould and separated from each other by a space whose width is a function of the conicity of the mould. When the dummy bar head is inserted into the mould, the plate halves are inserted into the space within the millimeter range. By dimensioning the space accordingly, one can thus fully compensate for the angled course of the mould.

In order to simplify production, it is likewise advantageous if the space is centrally formed. This makes it possible for both plate halves to be identical in form.

For the purpose of stable holding of the displaceable plate halves, the dummy bar head according to the invention has a one-piece packing plate covering both plate halves, which is clamped onto the dummy bar head. The plate halves are thus securely held over their surface area by the one-piece packing plate, without impairing their displaceability.

The one-piece packing plate is advantageously clamped onto the dummy bar head with tension rods affixed thereto. The tension rods also serve, in known fashion, to absorb the tensile loads acting between dummy bar and hot bar.

For free mobility of the displaceable plate halves in the area of the tension rods, the invention provides that the plate halves are equipped with through-holes formed as slots for the tension rods.

For the purpose of complete absorption of the forces acting during the insertion of the flat gasket, the one-piece packing plate according to the invention is provided with a reinforcing rib running in the longitudinal axis with which its rigidity, especially in the web area, is improved.

BRIEF DESCRIPTION OF THE DRAWINGS

The invention is next described in more detail on the basis of one embodiment, while making reference to the drawings, which show.

DETAILED DESCRIPTION OF THE INVENTION

Figure 1:
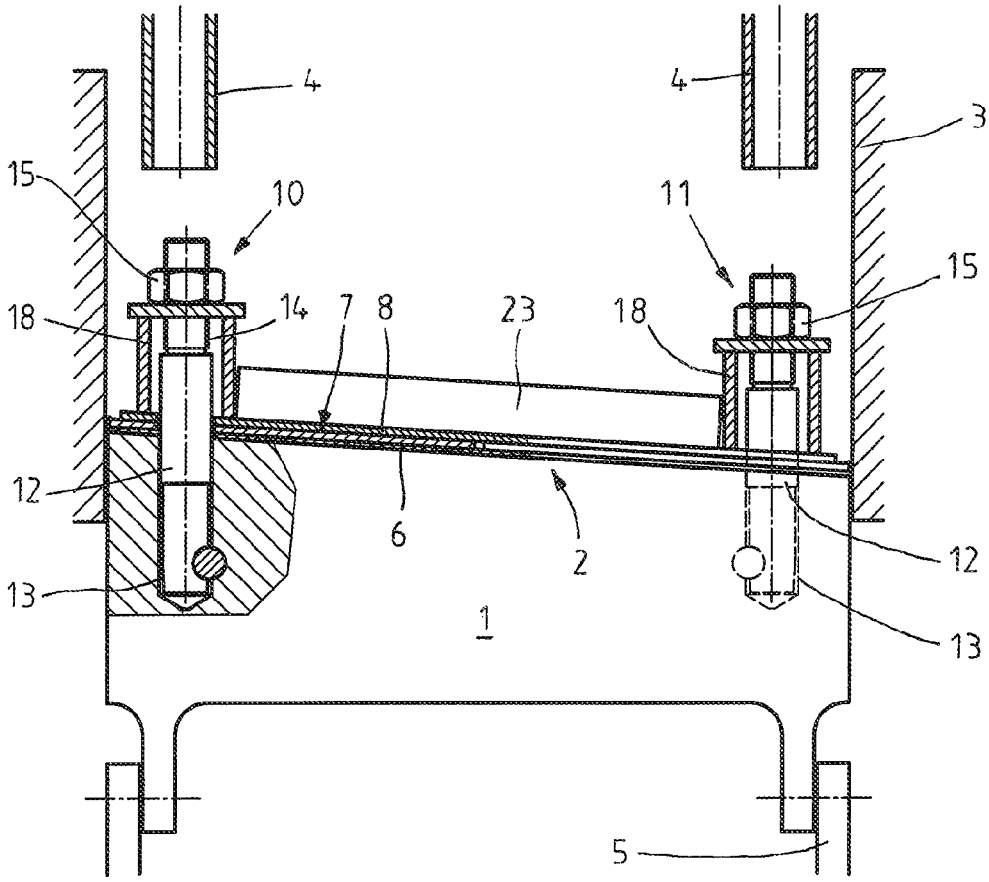
FIG. 1 a dummy bar packing according to the invention, shown in lateral view and in the casting start-up position, FIG. 2 the dummy bar packing according to FIG. 1 in top view, FIG. 3 the flat gasket of the dummy bar head according to FIG. 1 in top view, FIG. 4 the two-piece packing plate of the dummy bar head according to FIG. 1, again in top view, FIG. 5 the one-piece packing plate of the dummy bar head according to FIG. 1 from above, FIG. 6 the mould according to FIG. 1 shown in diagram form in top view, FIG. 7 in diagram form, a section through the mould along the line VII-VII in FIG. 7 with an illustration of the dummy bar packing in various positions, and FIG. 8 in diagram form, a partial section of the mould and a part of the dummy bar head according to FIG. 7.

The dummy bar head 1 shown in FIGS. 1 to 8 is equipped with a dummy bar packing 2 according to the invention. It is shown in the start position before starting the casting process, in which it seals off the interior of a mould 3 for casting a large-format beam-blank double-T profile, approx. 800 mm wide, 400 mm width of flange and 120 mm web thickness, at the bottom. Above the dummy bar head 1 is at least one pouring spout and channel 4 projecting into the mould 3, through which molten steel is poured into the interior of the mould 3 during casting. Underneath the dummy bar head 1, this is coupled to an extraction device 5, by means of which the bar is drawn out of the mould 3.

Figure 2:
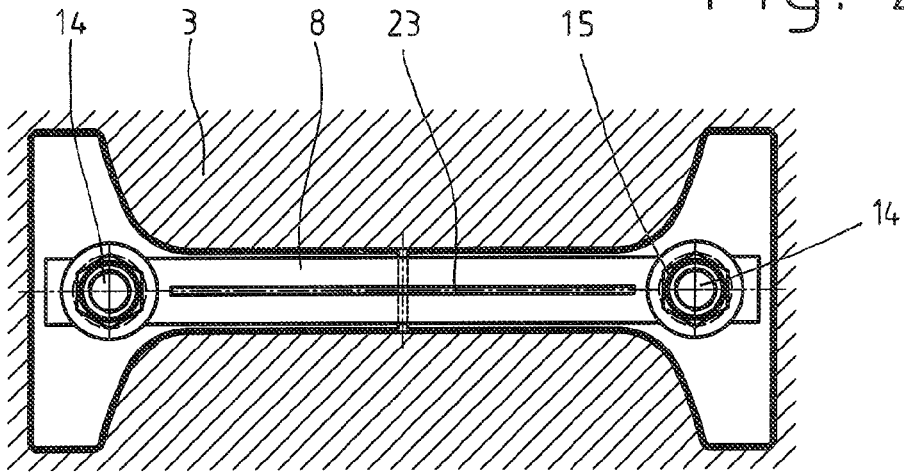

As can be seen especially from FIGS. 1 and 2, the dummy bar packing 2 consists of a flat gasket 6 and two packing plates 7 and 8, the packing plate 7 being divided into two plate halves 7*a*, 7*b* lying symmetrically to each other in one plane, between which there is a centrally-arranged, continuous space 9 of approx. 10 to 20 mm. The packing plate 8 on the other hand is one-piece and rectangular in form and covers the plate halves 7*a*, 7*b* in the web area. The packing plates 7 and 8 are produced from steel sheet with a thickness of approx. 8-15 mm.

Figure 3:
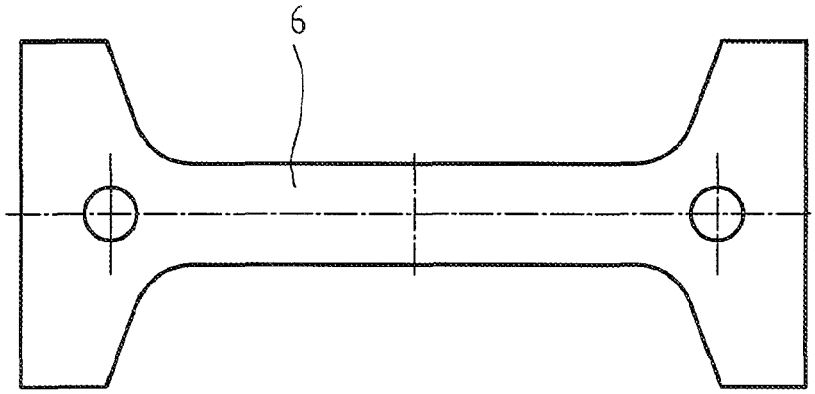
Figure 4:
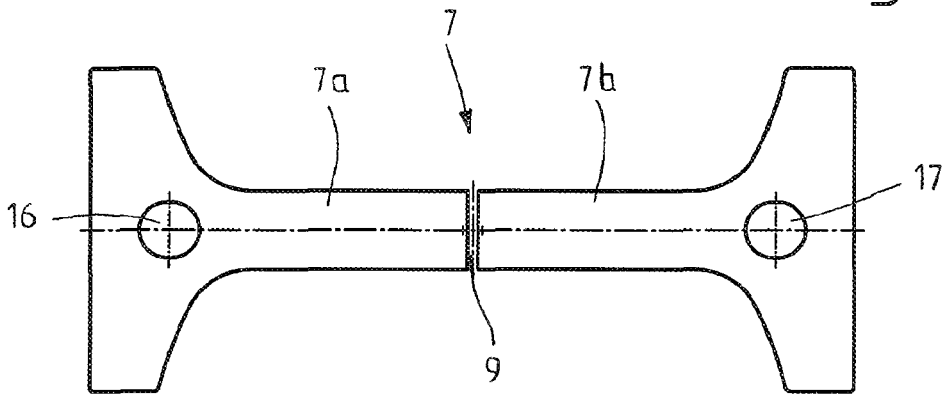
Figure 5:
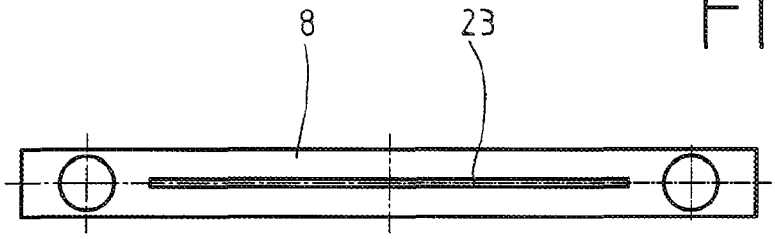

As can be seen from FIG. 3, the flat gasket 6 has the same outer contour as the inner contour of the mould, but with a slight overdimension of approx. 15 to 25 mm. It can be made of felt with a thickness of approx. 6-12 mm, but could easily also be made from any other material with comparable characteristics, in particular with respect to mechanical strength, elasticity and heat resistance.

The dummy bar packing 2 is mounted on the dummy bar head 1 outside the mould 3. At the same time the flat gasket 6 is clamped protruding between the dummy bar head 1 and the plate halves 7*a*, 7*b*. When the dummy bar head 1 is inserted into the mould, the protruding flat gasket bends around the outer edge of the plate halves 7*a*, 7*b* towards the inner walls of the mould and seals off the approx. 4-8 mm wide gap between packing plates and mould all round, so that no molten steel flows out of it during casting start-up.

The one-piece packing plate 8 is, for its part, pressed against the two plate halves 7*a*, 7*b* and has the task, together with the latter, of absorbing the forces acting during insertion of the flat gasket 6 in the entire profile area, including the web area.

Tension rods 10, 11 in the form of bolts 12 serve to fasten the dummy bar packing 2 onto the dummy bar head 1, said rods 10, 11 being inserted with the lower part 13 in the dummy bar head 1 and locked with a transversal bolt, and also an upper threaded part 14, onto which a nut 15 is screwed. The plate halves 7*a*, 7*b* have slots as through-holes for the tension rods 10 and 11. The nuts 15 are screwed tight against pressure bushings 18, which in turn are pressed against the one-piece packing plate 8. Care must be taken during mounting to ensure displaceability of the packing plates, i.e. the nuts 15 must not be over-tightened, unless a spacer ring is laid between the plates. The tension rods 10 and 11 also take over the tensile forces acting between hot bar and dummy bar during extraction of the bar.

In order to hold both plate halves 7*a*, 7*b* securely, especially in the web area, the one-piece packing plate 8 is provided with a longitudinal reinforcing rib 23, which gives the packing plate 8 greater rigidity in the central area. The reinforcing rib 23 extends between the two tension rods 10 and 11.

Further reinforcements, not shown in more detail, can be provided for the rigidity of the plate 8.

Figure 6:
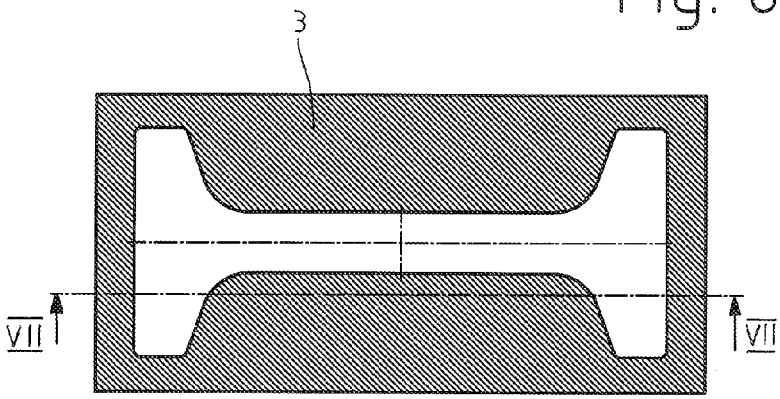
Figure 7:
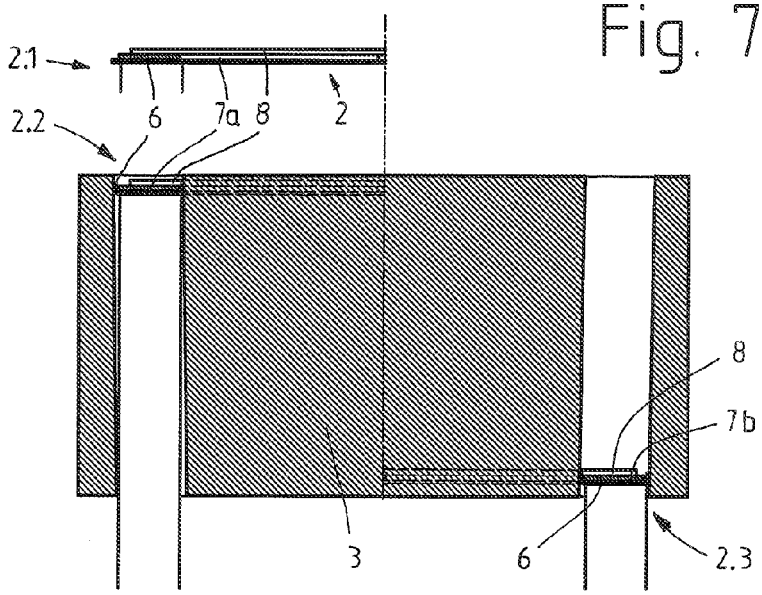
Figure 8:
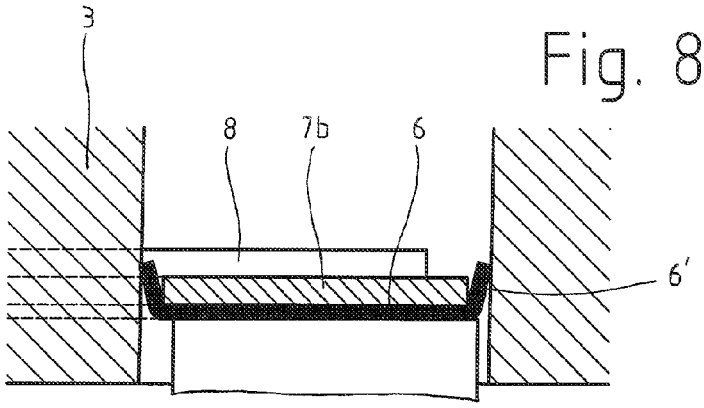

FIG. 7 shows the mould 3 in the section along the line VII-VII according to FIG. 6 and in diagram form, the dummy bar packing 2 in position 2.1 before insertion, in position 2.2 immediately after insertion in the mould 3 and additionally in position 2.3 on reaching the lower end of the mould 3, as also shown enlarged in FIG. 8.

The flat gasket 6 protrudes laterally all around the packing plate 7 located above it. As a result, it is uniformly angled away from the mould 3 as cover plate 6' and is therefore located between the self-displacing packing plate 7 and the mould and forms a secure seal all around. As the dummy bar head 1 is downwardly displaced in the mould 3, the adjustable packing plate 7 is steadily displaced, by the flat gasket sitting around the mould, towards the centre of the mould. The effect of this is more or less that the sealing gap between it and the packing plate 7 remains constant. In position 2.2, immediately after insertion of the dummy bar packing 2, the packing plate 7 is displaced outwards in relation to the shorter packing plate 8, while at the same time in position 2.3 this packing plate 7 is comparatively displaced further inwards.

It is thereby guaranteed that in the casting start-up position 2.3, the flat gasket 6 seals off the sealing gap with the cover plate 6' which is formed all around it and in particular also around the inner shoulders of the profile.

With respect to the insertability of the packing plate 7, it is also possible within the scope of the invention to provide other comparably effective elements, such as non-rigid plate areas or suchlike. It is also possible within the scope of the invention to make the space 9, depending on the profile geometry, non-uniform and/or to place it non-centrally in the packing plate.

The invention claimed is:

1. System for sealing a dummy bar head in a mould of a continuous casting plant for casting large-format preliminary sections, comprising:

a flat gasket sealing a gap between the dummy bar head and the mould;

a two-piece packing plate fixing the flat gasket onto the dummy bar head, said two-piece packing plate having approximately the cross-sectional form of a mould profile and covering the flat gasket, the two-piece packing plate being displaceable towards a center of the mould by an amount which is a function of conicity of the mould, the two-piece packing plate consisting of two plate halves which are displaceable towards the center of the mould and separated from each other by a space whose width is a function of the conicity of the mould; and a one-piece packing plate mounted on the dummy bar head and covering the two-piece packing plate, the one-piece packing plate being arranged on an opposite side of the two-piece packing plate from the gasket such that the two-piece packing plate is situated between the one-piece packing plate and the gasket.

2. System for sealing a dummy bar head according to claim 1, wherein the two plate halves lie symmetrically in relation to each other in a plane.

3. System for sealing a dummy bar head according to claim 1, wherein the flat gasket projects laterally all around the two-piece packing plate located above it, and it is thereby evenly bent downwards by the mould and is positioned between the two-piece packing plate and the mould and forms a secure seal all around.

4. System for sealing a dummy bar head according to claim 1, wherein the one-piece packing plate is mounted against the dummy bar head with tension rods affixed thereto.

5. System for sealing a dummy bar head according to claim 4, wherein the plate halves of the two-piece packing plate are provided with through holes in the form of slots for the tension rods.

6. System for sealing a dummy bar head according to claim 1, wherein the one-piece packing plate is provided with a reinforcing rib running longitudinally along the one-piece packing plate.

7. System for sealing a dummy bar head according to claim 4, wherein the one-piece packing plate is provided with a reinforcing rib running longitudinally along the one-piece packing plate.

8. System for sealing a dummy bar head according to claim 5, wherein the one-piece packing plate is provided with a reinforcing rib running longitudinally along the one-piece packing plate.

9. System for sealing a dummy bar head in a mould of a continuous casting plant for casting large-format preliminary sections, comprising:

a flat gasket sealing a gap between the dummy bar head and the mould;

a first packing plate fixing the flat gasket onto the dummy bar head, the first packing plate having approximately the cross-sectional form of a mould profile and covering the flat gasket, the first packing plate being displaceable towards a center of the mould by an amount which is a function of conicity of the mould, the flat gasket projecting laterally all around the first packing plate located above it, and it is thereby evenly bent downwards by the mould and is positioned between the first packing plate and the mould and forms a secure seal all around; and a second, one-piece packing plate mounted on the dummy bar head and covering the first packing plate, the second packing plate being arranged on an opposite side of the first packing plate from the gasket such that the first packing plate is situated between the second packing plate and the gasket.

10. System for sealing a dummy bar head according to claim 9, wherein the one-piece packing plate is mounted against the dummy bar head with tension rods affixed thereto.

11. System for sealing a dummy bar head according to claim 10, wherein the first packing plate is a two-piece packing plate consisting of two plate halves which are displaceable towards the center of the mould and separated from each other by a space whose width is a function of the conicity of the mould, and the plate halves are provided with through holes in the form of slots for the tension rods.

12. System for sealing a dummy bar head according to claim 9, wherein the one-piece packing plate is provided with a reinforcing rib running longitudinally along the one piece packing plate.

13. System for sealing a dummy bar head according to claim 10, wherein the one-piece packing plate is provided with a reinforcing rib running longitudinally along the one-piece packing plate.

14. System for sealing a dummy bar head according to claim 11, wherein the one-piece packing plate is provided with a reinforcing rib running longitudinally along the one-piece packing plate.

15. System for sealing a dummy bar head according to claim 9, wherein the first packing plate is a two-piece packing plate consisting of two plate halves which are displaceable towards the center of the mould and separated from each other by a space whose width is a function of the conicity of the mould, and the two plate halves lie symmetrically in relation to each other in a plane.

* * * * *